US011370632B2

(12) United States Patent
Kubo

(10) Patent No.: US 11,370,632 B2
(45) Date of Patent: Jun. 28, 2022

(54) SHEET STACKING APPARATUS AND IMAGE FORMING SYSTEM

(71) Applicant: Mamoru Kubo, Yamanashi-ken (JP)

(72) Inventor: Mamoru Kubo, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 264 days.

(21) Appl. No.: 16/706,038

(22) Filed: Dec. 6, 2019

(65) Prior Publication Data

US 2020/0180882 A1 Jun. 11, 2020

(30) Foreign Application Priority Data

Dec. 7, 2018 (JP) ..... JP2018-229531
Dec. 5, 2019 (JP) ..... JP2019-220716

(51) Int. Cl.

| | |
|---|---|
| ***B65H 31/38*** | (2006.01) |
| ***G03G 15/00*** | (2006.01) |
| ***B65H 29/24*** | (2006.01) |
| ***B65H 31/36*** | (2006.01) |
| ***B65H 33/08*** | (2006.01) |

(52) U.S. Cl.

CPC ..... *B65H 31/38* (2013.01); *B65H 31/36* (2013.01); *B65H 33/08* (2013.01); *G03G 15/5062* (2013.01); *B65H 29/246* (2013.01); *B65H 2301/4212* (2013.01); *B65H 2406/11* (2013.01); *B65H 2801/27* (2013.01); *G03G 15/6552* (2013.01)

(58) Field of Classification Search

CPC ..... B65H 31/38; B65H 29/246; B65H 2301/4212; B65H 2406/11; G03G 15/5062; G03G 15/6552

See application file for complete search history.

(56) References Cited

U.S. PATENT DOCUMENTS 8,577,273 B2 * 11/2013 Inoue ..... B65H 85/00 399/341
8,606,168 B2 * 12/2013 Murakami ..... G03G 15/6573 399/405
8,936,240 B2 * 1/2015 Hoshino ..... B65H 29/125 271/211

(Continued)

FOREIGN PATENT DOCUMENTS

JP 2012-101942 A 5/2012
JP 2015-16970 A 1/2015
JP 2017-132636 A 8/2017

*Primary Examiner* — Patrick Cicchino
(74) *Attorney, Agent, or Firm* — Manabu Kanesaka

(57) ABSTRACT

In order to properly suppress a discharge defect corresponding to an image ratio of a sheet, in the case where a coefficient of friction is different according to the image ratio of an image on the sheet, an air blowing section is arranged to blow air toward a downstream side in a transport direction from between a downstream-side end portion of a first stacking section and an upstream-side end portion of a second stacking section. When an image ratio of an image on a sheet by an image forming apparatus is a first value, the air blowing section sets an air quantity blown to the sheet at a first air quantity F1, while when the image ratio is a second value higher than the first value, setting the air quantity blown to the sheet at a second air quantity F2 larger than the first air quantity F1.

8 Claims, 8 Drawing Sheets

(56) References Cited

U.S. PATENT DOCUMENTS

| | | | | |
|---|---|---|---|---|
| 10,775,720 | B2 * | 9/2020 | Suzuki | G03G 15/5062 |
| 10,829,333 | B2 * | 11/2020 | Kubo | B41J 29/38 |
| 2012/0093555 | A1 | 4/2012 | Obuchi | |
| 2015/0014384 | A1 | 1/2015 | Obuchi et al. | |
| 2017/0210122 | A1 | 7/2017 | Kodama et al. | |

* cited by examiner

SHEET STACKING APPARATUS AND IMAGE FORMING SYSTEM

CROSS-REFERENCE TO RELATED APPLICATION

The present application is based on and claims priority of Japanese Patent Applications No. 2018-229531 filed on Dec. 7, 2018; and No. 2019-220716 filed on Dec. 5, 2019, the disclosure of which is incorporated herein.

TECHNICAL FIELD

The present invention relates to a sheet stacking apparatus for stacking sheets, and an image forming system for forming images on sheets.

BACKGROUND ART

Conventionally, image forming systems have been known where an image forming apparatus performs printing processing on sheets, printed sheets are once stacked on a processing tray (first stacking section) to perform post-processing such as binding processing and shift sheet discharge processing, and the sheets are discharged to a stack tray (second stacking section) (for example, Patent Document 1). In such an image forming system, in recent years, there has been a growth of the inkjet type of image forming section, and a system is also known where post-processing is performed on sheets printed by the inkjet type (for example, Patent Document 2).

PRIOR ART DOCUMENT

Patent Document

[Patent Document 1] Japanese Patent Application Publication No. 2015-16970

[Patent Document 2] Japanese Patent Application Publication No. 2017-132636

DISCLOSURE OF INVENTION

Problems to be Solved by the Invention

However, when image formation is performed by the inkjet type as in Patent Document 2, in the case where an image ratio is high (e.g., printing of an entire surface solid image), stiffness of the sheet decreases, while weight is increased, and there is a possibility that a coefficient of friction increases with respect to other member, sheet and the like. In this case, in processing a sheet in a post-processing apparatus and discharging the sheet from a processing tray to a stack tray, slidability is poor between the sheet (in forming a bunch of sheets, the sheet discharged to the processing tray first in a job) and the processing tray, stack tray, or sheet already placed on the stack tray, and there is the risk that the sheet is normally not discharged and that a discharge defect occurs. Therefore, conventionally, it has been desired to suppress the discharge defect based on an image ratio of the sheet.

Therefore, it is an object of the present invention to provide a sheet stacking apparatus and image forming system capable of properly suppressing a discharge defect corresponding to an image ratio of a sheet, also in the case where a coefficient of friction is different according to the image ratio of an image formed on the sheet, in discharging the sheet from the processing tray to the stack tray.

Means for Solving the Problem

A sheet stacking apparatus of the present invention is a sheet stacking apparatus for stacking sheets with images formed in an image forming apparatus, and is provided with a first stacking section that enables a sheet to be stacked, a discharge section that discharges the sheet with an image formed in the image forming apparatus to the first stacking section, a transport section that transports the sheet stacked on the first stacking section, a second stacking section that enables the sheet transported from the first stacking section by the transport section to be stacked where an upstream end of the sheet in a transport direction by the transport section is disposed lower in a vertical direction than a downstream-side end portion of the first stacking section in the transport direction, and an air blowing section that enables air to be blown toward a downstream side in the transport direction from between the downstream-side end portion of the first stacking section and an upstream-side end portion of the second stacking section, where when an image ratio of the image formed on the sheet by the image forming apparatus is a first value, the air blowing section sets an air quantity blown to the sheet at a first air quantity, while when the image ratio is a second value higher than the first value, setting the air quantity blown to the sheet at a second air quantity larger than the first air quantity.

Further, a sheet stacking apparatus of the present invention is a sheet stacking apparatus for stacking sheets with images formed in an image forming apparatus, and is provided with a first stacking section that enables a sheet to be stacked, a discharge section that discharges the sheet with an image formed in the image forming apparatus to the first stacking section, a transport section that transports the sheet stacked on the first stacking section, a second stacking section that enables the sheet transported from the first stacking section by the transport section to be stacked where an upstream end of the sheet in a transport direction by the transport section is disposed lower in a vertical direction than a downstream-side end portion of the first stacking section in the transport direction, an air blowing section that enables air to be blown toward a downstream side in the transport direction from between the downstream-side end portion of the first stacking section and an upstream-side end portion of the second stacking section, and a wind direction changing section that enables an air blow direction from the air blowing section to be changed, where when an image ratio of the image formed on the sheet by the image forming apparatus is a first value, the wind direction changing section sets the air blow direction to the sheet by the air blowing apparatus at a direction inclined a first angle with respect to a horizontal direction, while when the image ratio is a second value higher than the first value, setting the air blow direction to the sheet by the air blowing apparatus at a direction inclined a second angle larger than the first angle with respect to the horizontal direction.

An image forming system of the present invention is provided with an image forming apparatus provided with an image forming section for forming an image on a sheet, and the above-mentioned sheet stacking apparatus for stacking sheets with images formed in the image forming apparatus.

Advantageous Effect of the Invention

According to the sheet stacking apparatus and image forming system of the present invention, it is possible to properly suppress a discharge defect corresponding to an image ratio of a sheet, also in the case where a coefficient of friction is different according to the image ratio of an image formed on the sheet, in discharging the sheet from the processing tray to the stack tray.

BRIEF DESCRIPTION OF DRAWINGS

FIG. 4A is a view when a sheet is transported to a discharge roller, FIG. 4B is a view when the sheet is discharged to a processing tray, FIG. 4C is a view when the sheet is shifted to a sheet end regulating member, and FIG. 4D is a view when a bunch of sheets is pushed out to a stack tray;

FIG. 5A is a view when a front end of the sheet discharged from the discharge roller protrudes from the processing tray, and FIG. 5B is a view when the entire sheet is discharged to the processing tray from the discharge roller;

FIG. 6A is a view when a bunch of sheets stacked on the processing tray is subjected to binding processing, and FIG. 6B is a view immediately before the whole of the bunch of sheets subjected to the binding processing is discharged from the processing tray by a bunch discharge member;

BEST MODE FOR CARRYING OUT THE INVENTION

Embodiment 1

Embodiment 1 will be described with reference to FIGS. 1 to 7. First, a schematic configuration of an image forming system of this Embodiment will be described using FIG. 1.

[Image Forming System]

Figure 1:
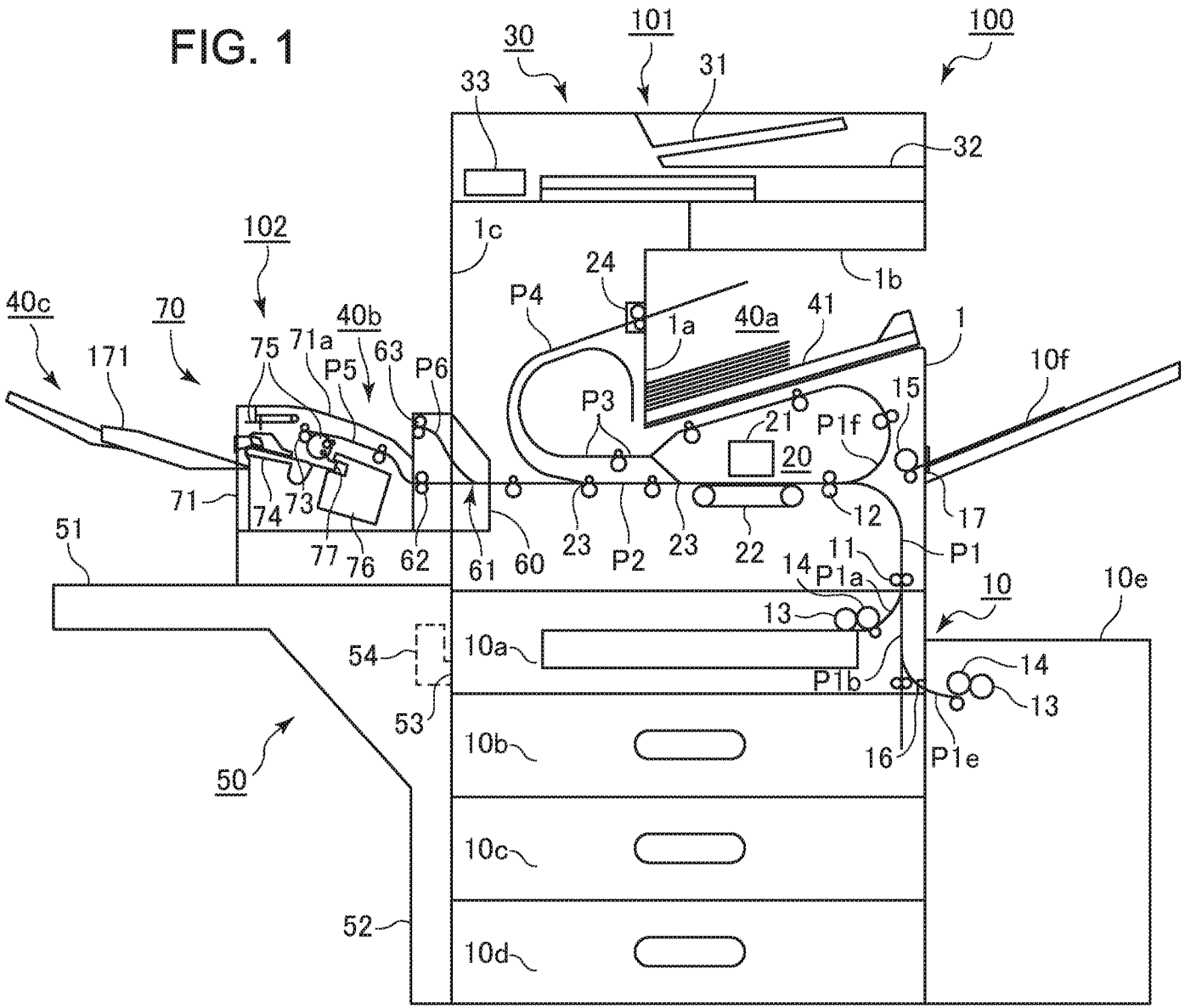
FIG. 1 is a schematic view of an image forming system according to Embodiment 1.

FIG. 1 schematically illustrates an entire configuration of an image forming system 100 according to this Embodiment. As shown in FIG. 1, the image forming system 100 is comprised of an image forming apparatus 101, and sheet processing apparatus 102 provided in the apparatus 101. The image forming apparatus 101 is comprised of a paper feed unit 10, image forming unit 20, and image reading unit 30. The sheet processing apparatus 102 is comprised of a relay transport unit 60 and post-processing unit 70.

[Image Forming Apparatus]

The image forming apparatus 101 will be described first. The paper feed unit 10 of the image forming apparatus 101 is provided below the image forming apparatus 101, is comprised of a plurality of cassette mechanisms 10*a*, 10*b*, 10*c*, 10*d* for storing sheets for image formation of respective different sizes, and a high-capacity cassette 10*e*, and feeds out a sheet of a size designated by an operator such as a user with an input section 86 (see FIG. 3) to a paper feed path P1. Further, the paper feed unit 10 also includes a manual tray 10*f*. Each of the cassette mechanisms 10*a*, 10*b*, 10*c*, 10*d* is provided to be attachable/detachable to/from an apparatus housing 1, and into each mechanism are incorporated a separation mechanism for separating sheets inside on a sheet-by-sheet basis, and a paper feed mechanism for feeding out the sheet.

The paper feed path P1 is connected to the high-capacity cassette 10*e* and manual tray 10*f*. The high-capacity cassette 10*e* and manual tray 10*f* are provided on one side (right side in FIG. 1) of the apparatus housing 1, and the apparatus housing 1 is provided with sheet supply openings (paper feed openings) 16, 17 that support the cassette 10*e* and tray 10*f*, respectively. The high-capacity cassette 10*e* is comprised of an option unit for storing sheets of a size consumed in large quantity. The manual tray 10*f* is configured to enable particular sheets such as thick sheets, coating sheets and film sheets difficult to separate and feed to be supplied. In other words, sheets used in this Embodiment include various sheet materials as well as normal paper for printing. As examples of sheet materials, there are paper such as thick paper and thin paper, plastic film such as a sheet for overhead projector, cloth, sheet material provided with surface treatment such as coated paper, and sheet materials in particular forms such as an envelope and index paper.

The paper feed path P1 is provided with a transport roller pair 11 for feeding, to the downstream side, a sheet supplied from each of the cassette mechanisms 10*a*, 10*b*, 10*c*, 10*d* and high-capacity cassette 10*e* via paper feed paths P1*a*, P1*b*, P1*e*, and a registration roller pair 12. The registration roller pair 12 is provided in a tail end portion of the paper feed path P1, and after correcting skew of the sheet by coming into contact with the sheet front end (downstream end in a transport direction), sends out the sheet to the image forming unit 20. Further, a sheet supplied from the manual tray 10*f* is sent to the registration roller pair 12 via a paper feed path P1*f*.

In addition, each of the cassette mechanisms 10*a*, 10*b*, 10*c*, 10*d* and high-capacity cassette 10*e* is provided with a pick-up roller 13 that is an example of the paper feed mechanism, and a transport roller pair 14 that is an example of the separation mechanism, and supplies the sheet on a sheet-by-sheet basis to the paper feed path P1 by these mechanisms. In the vicinity of the sheet supply opening 17 of the manual tray 10*f* inside the apparatus housing 1, a transport roller pair 15 is provided, and transports the sheet manually supplied by the user to the registration roller pair 12.

The image forming unit 20 is provided on the transport path P2 above the cassette mechanism 10*a*, and for example, is provided with an image forming section 21 having a printing head of the inkjet type. The image forming section 21 is provided in a position opposed to a transport belt 22 with the transport path P2 therebetween. The image forming section 21 injects liquid such as ink to the sheet which is supported and transported by the transport belt 22 along the transport path P2, and thereby attaches the liquid to the sheet to print. The image forming section 21 of this Embodiment is comprised of line heads capable of injecting ink concurrently over a predetermined range in a direction (particularly, width direction orthogonal to the transport direction) crossing the transport direction of the sheet.

In addition, the image forming section of the present disclosure is not limited to the inkjet type, and for example, may be an electrophotographic unit provided with a photosensitive drum that rotates, and a light emitting device such as a laser light emitting device and LED light emitting device, developing device and cleaner disposed around the drum. In this case, a latent image is optically formed on the photosensitive drum by the light emitting device, and toner is attached to the latent image using the developing device. In accordance with timing at which the image is formed on the photosensitive drum, the sheet is transported to the transport path P2, and a toner image is transferred onto the sheet from the photosensitive drum by a transfer charger. A fuser roller disposed on the downstream side of the transfer charger in the sheet transport direction provides the toner image transferred to the sheet with heat generated by a heat source such as a halogen heater to melt the toner. Subsequently, the toner adheres to the sheet in association with decreases in temperature, and the image fused on the sheet is thereby obtained.

The sheet provided with image forming processing by the image forming unit 20 is transported to a sheet reverse path P3, a transport path P4 to discharge to a first discharge section 40*a*, or a transport path P5 to transport to the relay transport unit 60. A path switch section 23 shifts a switch member not shown corresponding to a transport destination of the sheet, and guides the sheet to the sheet reverse path P3 or one of the transport paths P4, P5.

The sheet reverse path P3 is a transport path to reverse the side of the sheet, is used in two-side printing, and also in one-side printing, is used in the case of transporting to the post-processing unit 70, described later, face down (state of facing the printed surface of the sheet downward).

The transport path P4 is a transport path to discharge the sheet to the first discharge section 40*a*. In the case of discharging the sheet to the first discharge section 40*a*, the sheet is delivered to the transport path P4 from the transport path P2 by the path switch section 23, and is discharged to a sheet placement face (placement section) 41 in a state of face-down with the printed surface (second printed surface in two-side printing) of the sheet faced downward. The transport path P4 is curved (so as to draw an arc) upward from the substantially horizontal transport path P2 with the path switch section 23 being a starting point, and is formed toward a sheet discharge outlet 24 provided in the apparatus housing 1 from a tail end of the curved portion.

In the case where the sheet is transported to the relay transport unit 60, the path switch section 23 does not switch the path, and the sheet is transported straight along the transport path P2. In addition, in transporting the sheet to the relay transport unit 60, in the case of transporting face up (state of facing the printed surface of the sheet upward), the reverse processing by the sheet reverse path P3 is not performed, and in the case of transporting face down, the sheet is transported after reversing the side using the sheet reverse path P3.

The image reading unit 30 is provided above the first discharge section 40*a* and transport path P4, and is comprised of an image reading section 33 for reading an image of an original document, an original document feed tray 31 on which the fed original document is placed, and an original document discharge tray 32 to which the original document with the image read in the image reading section 33 is discharged. The image reading unit 30 performs photoelectric conversion on the original document image read by the image reading section 33 into image data, and outputs to the image forming unit as an electric signal. In addition, an image of an original document may be read using platen to place the original document, a carriage that reciprocates along the platen, and the image reading section 33 provided in the carriage.

[Sheet Processing Apparatus]

The sheet processing apparatus 102 will be described next. The relay transport unit 60 of the sheet processing apparatus 102 is a unit to transport the sheet subjected to the image forming processing in the image forming unit 20 to the post-processing unit 70, and has a path switch section 61. The path switch section 61 switches the transport path between the transport path P5 to discharge the sheet to a stack tray 171 as a second stacking section of the post-processing unit 70, and a transport path P6 to discharge the sheet to a sheet placement face 71*a* that is the top face of a unit housing 71 of the post-processing unit 70. The sheet passing through the transport path P5 is discharged to the post-processing unit 70 by a discharge roller 62, and the sheet passing through the transport path P6 is discharged to the sheet placement face 71*a* of the post-processing unit 70 by a discharge roller 63. The sheet placement face 71*a* of the post-processing unit 70 constitutes a second discharge section 40*b* of the image forming system 100, and the stack tray 171 constitutes a third discharge section 40*c* of the image forming system 100.

Whether to make the sheet discharge destination of the sheet processing apparatus 102 the stack tray 171 or the sheet placement face 71*a* is switched by whether or not to perform post-processing such as binding processing on sheets. In this Embodiment, since the sheet is discharged to the sheet placement face 71*a* straight, mode sorting may be performed so as to discharge to the first discharge section 40*a* in the case of discharging the sheet face down, and discharge to the second discharge section 40*b* in the case of discharging the sheet face up. In addition, in the case where the discharge roller 63 provided in the transport path P6 is configured to be movable in the width direction orthogonal to the sheet transport direction, it is possible to perform jog discharge by shifting the sheet in the width direction in the second discharge section 40*b*.

The post-processing unit 70 is a unit for applying the post-processing such as the binding processing to the sheet received from the relay transport unit 60. The post-processing unit of this Embodiment is equipped with a sheet binding processing mechanism which collates and collects a plurality of transported sheets to form a bunch of sheets, and performs the binding processing on the bunch of sheets.

In addition, this Embodiment describes the configuration where the relay transport unit 60 exists between the image forming apparatus 101 and the post-processing unit 70, and the post-processing unit 70 may be directly coupled to the image forming apparatus 101. In other words, the post-processing unit 70 is capable of functioning as a processing apparatus in a single unit that is not combined with the relay transport unit 60. Further, irrespective of whether or not the unit 70 has the function for applying the post-processing to the sheet, the post-processing unit 70 is also an example of sheet stacking apparatuses for stacking sheets with images formed by the image forming apparatus 101.

Figure 2:
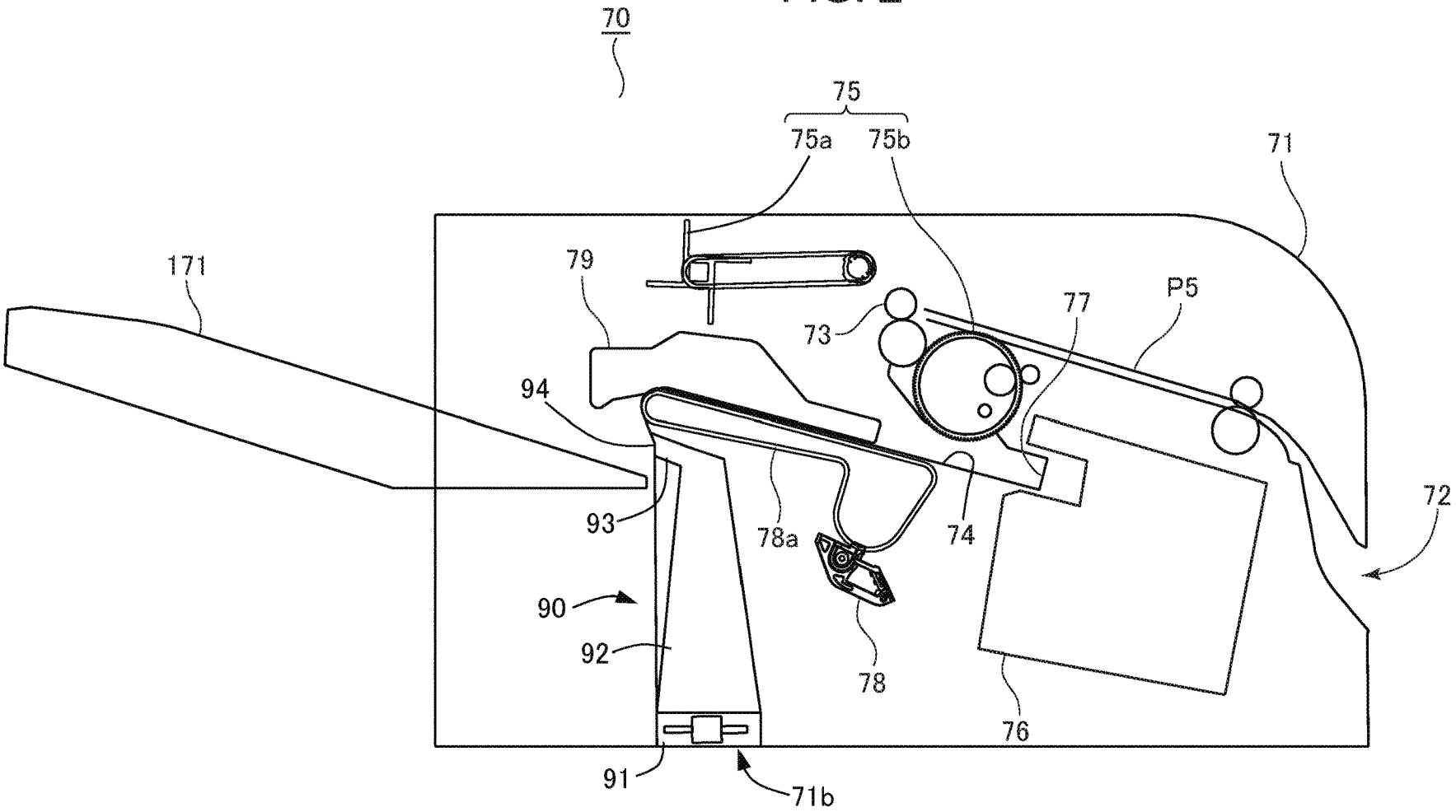
FIG. 2 is a schematic view of a post-processing apparatus of Embodiment 1.

A configuration of the post-processing unit 70 as the sheet stacking apparatus will be described with reference to FIG. 2. The post-processing unit 70 holds, inside the unit housing 71, a sheet supply opening 72, transport path P5, discharge roller 73 as a discharge means, processing tray 74 as the first stacking section capable of stacking sheets, sheet carry-in member 75, staple binding processing section 76 as a processing means, sheet end regulating member 77, width aligning member 79, and bunch discharge member 78 as a transport means, and the stack tray 171 capable of moving up and down is provided on the side opposite to the sheet supply opening 72.

In the stack tray 171, an upstream end of the sheet in the transport direction by the bunch discharge member 78 is disposed lower in the vertical direction than a downstream-side end portion of the processing tray 74 in the transport direction, and it is thereby possible to stack sheets transported from the processing tray 74 by the bunch discharge member 78. Further, an air blowing apparatus 90 is provided between the processing tray 74 and the stack tray 171.

The sheet carry-in member 75 is comprised of a paddle 75*a* and knurl belt 75*b*, and is a member to transport the sheet in the direction of striking the sheet rear end (upstream end in the transport direction of the sheet transported by the discharge roller 73) on the processing tray 74 against the sheet end regulating member 77. In other words, the sheet received from the image forming apparatus 101 via the relay transport unit 60 and sheet supply opening 72 is transported by the discharge roller 73, and is discharged to the processing tray 74 to be placed. At this point, the sheet is transported in the direction opposite to the transport direction by the discharge roller 73, by the paddle 75*a* and knurl belt 75*b*, and the end portion of the sheet is struck against the sheet end regulating member 77. The sheet end regulating member 77 is positioned in an upstream end portion of the processing tray 74 with respect to the discharge direction of the sheet by the bunch discharge member 78 described later, and is capable of regulating the upstream end portion of the sheet placed on the processing tray 74. The paddle 75*a* and knurl belt 75*b* are configured to be able to shift between respective retract positions separated from the sheet and respective operation positions for contacting the sheet to rotate, rotate in a counterclockwise direction in the FIG. 2 in the operation positions, and thereby transport the sheet.

The width aligning member (aligning member) 79 is comprised of a pair of aligning members each capable of shifting in the sheet width direction (direction crossing the discharge direction of the sheet by the bunch discharge member 78 (orthogonal direction in this Embodiment)), and in the sheet width direction, regulates end portion positions of the sheet placed on the processing tray 74. The width aligning member 79 is configured to be able to shift between retract positions separated from side ends (side ends in the sheet width direction) of the sheet and operation positions that correspond to target positions (alignment positions) in aligning the sheet with respect to the sheet width direction. In the width aligning member 79, at least one of the aligning members shifts from the retract position to the operation position, while contacting the side end of the sheet, and thereby aligns the sheet discharged to the processing tray 74 in the alignment position. In addition, it is not necessary that the aligning members on both sides always shift, and it may be configured that one of the aligning members is a fixed regulating member to a frame of the post-processing unit 70, and that only the other one of the aligning members shifts to perform aligning operation in the sheet width direction with respect to the fixed regulating member. Further, the other one of the aligning members does not need to contact the end edge in the sheet width direction to shift, and by providing a member that contacts the top face of the sheet to be able to shift in the sheet width direction, or a roller member that transports the sheet in the sheet width direction, it is possible to perform sheet width aligning operation.

The staple binding processing section 76 is to perform the binding processing on a bunch of sheets which are aligned and collected in the sheet transport direction and sheet width direction on the processing tray 74. In other words, the staple binding processing section 76 applies the processing to a sheet bunch SB comprised of a plurality of sheets stacked on the processing tray 74. The staple binding processing section 76 is configured to be able to shift in the sheet width direction, and is capable of performing the binding processing in a corner portion of the sheet bunch and a predetermined position of the sheet end edge in contact with the sheet end regulating member 77. In addition, this Embodiment adopts the needle binding mechanism using a staple, and may adopt a needleless binding mechanism without using the staple. Alternatively, the needle binding mechanism and needleless binding mechanism may be provided on the front side (front side of the image forming system 100, front side in FIG. 1) and on the rear side (back side in FIG. 1) of the post-processing unit 70, respectively to switch between needle binding and needleless binding corresponding to setting of a user.

The bunch discharge member 78 is driven by a discharge member drive section M6 (FIG. 3), pushes out the rear end edge of the sheet bunch, and thereby transports the sheet bunch on the processing tray 74 to the stack tray 171 to discharge. In other words, the bunch discharge member 78 transports the sheet bunch SB subjected to the processing by the staple binding processing section 76 from the processing tray 74 to the stack tray 171. The bunch discharge member 78 is configured to retract below the processing tray 74 until the sheet bunch is formed, and after the sheet bunch is formed on the processing tray 74 (after the binding processing is performed in the case of performing the binding processing), shift along a guide member 78*a*, thereby contact the rear end edge of the sheet bunch, and push out the sheet bunch to the stack tray 171. In addition, as well as the sheet bunch subjected to the staple processing as described above, the bunch discharge member 78 is capable of discharging a sheet bunch that is not subjected to the staple processing.

Figure 4A:
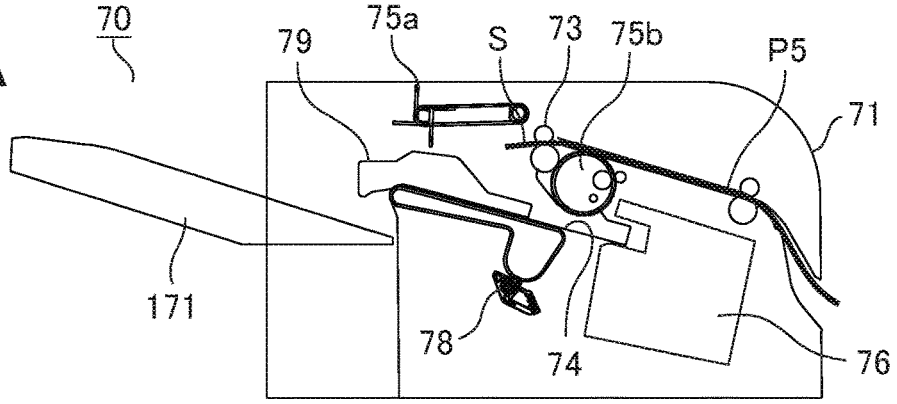
FIGS. 4A to 4D contain views to explain bunch forming processing by a post-processing unit of Embodiment 1, where
Figure 4B:
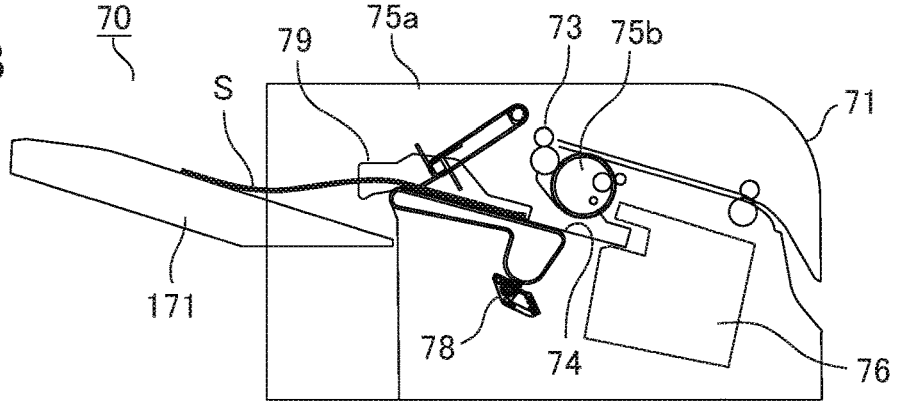
Figure 4C:
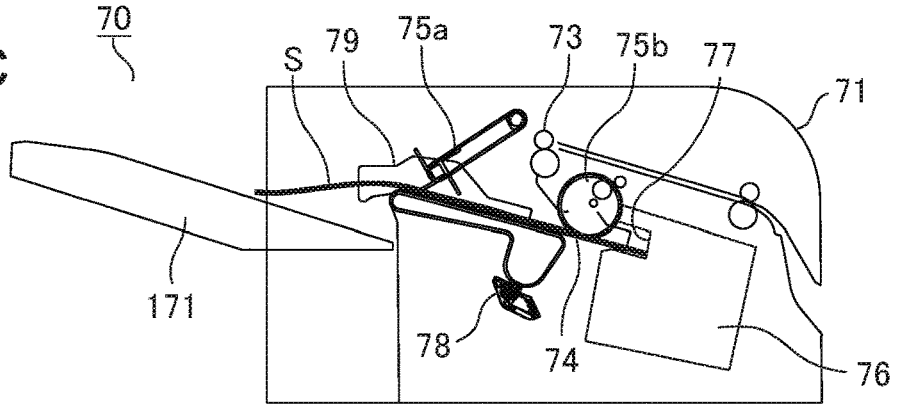
Figure 4D:
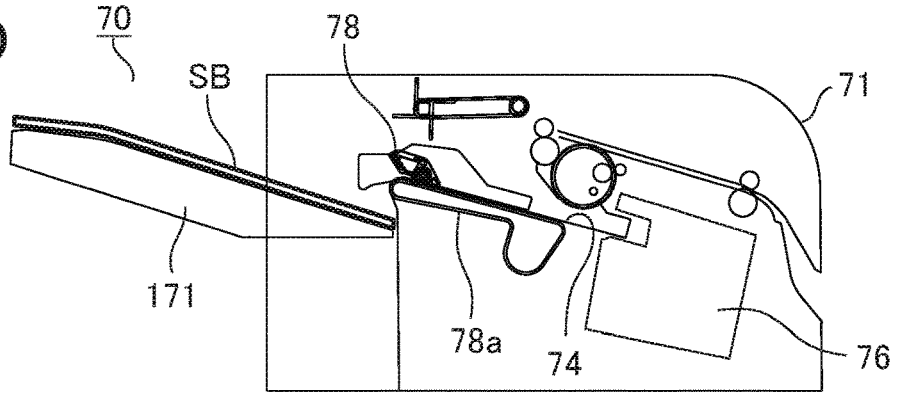

FIGS. 4A to 4D illustrate a basic procedure of the staple binding processing by the post-processing unit 70. As shown in FIG. 4A, a sheet S is delivered from the relay transport unit 60 to the post-processing unit 70. As shown in FIG. 4B, the sheet S is discharged to the processing tray 74 by the discharge roller 73, and the paddle 75*a* and knurl belt 75*b* move downward to respective operation positions, and sequentially contact the sheet S. As shown in FIG. 4C, the sheet S is shifted toward the sheet end regulating member 77. The sheet S comes into contact with the sheet end regulating member 77, the position in the transport direction is thereby aligned, and the position in the sheet width direction is aligned by the width aligning member 79. Such aligning operation is repeated whenever the single sheet S is discharged, and in a state in which the number of sheets to form a sheet bunch is aligned and collected, the staple binding processing section 76 binds a predetermined position of the sheet bunch. Subsequently, as shown in FIG. 4D, the bunch discharge member 78 comes into contact with the rear end edge of the sheet bunch SB, and pushes out the sheet bunch SB to the stack tray 171.

In addition, for example, details on configurations of the discharge roller 73, processing tray 74, sheet carry-in member 75, staple binding processing section 76, sheet end regulating member 77, width aligning member 79 and bunch discharge member 78 described above are described in Japanese Unexamined Patent Publication No. 2015-16970 and the like, and not only needle binding, it is also possible to apply various post-processing units of needleless binding, punching, folding processing and the like. Further, without performing the binding processing, it is also possible to shift the sheet in the sheet width direction to discharge to the stack tray 171, and this processing is capable of being included also in the post-processing. In the case of shifting the sheet in the width direction, it is possible to achieve the shift by changing a position aligned by the width aligning member 79, or changing a discharge position of the sheet by a mechanism for shifting the discharge roller 73 in the sheet width direction.

As shown in FIG. 1, the post-processing unit 70 (and the relay transport unit 60) of this Embodiment is installed on a stall 50 on the side of the image forming apparatus 101. The stall 50 is comprised of an installation portion 51, leg portion 52 and opening 53, and is fixed by hooking, on the opening 53, a hook member 54 provided on the side of the image forming apparatus 101. The installation portion 51 is provided with a slide rail not shown, and the post-processing unit 70 is configured to be able to perform a slide shift in the left-right direction in FIG. 1. The post-processing unit 70 (and the relay transport unit 60) is separated from the image forming apparatus 101, and it is thereby possible to perform jam resolving processing when a sheet jams.

When the post-processing unit 70 shifts to the front end side of the installation portion 51, force is acted upon the stall 50 in the counterclockwise direction, the leg portion 52 is supported by the hook member 54 and a side face portion 1*c* of the image forming apparatus 101, and the stall 50 does thereby not fall.

[Discharge Configuration]

In this Embodiment, a plurality of discharge sections is provided to discharge the processed sheet. As described above, the first discharge section 40*a* is a discharge section to discharge straight the sheet subjected to the image forming processing in the image forming section 21 face down, or to reverse the side of the sheet with the sheet reverse path P3 to discharge face up. The first discharge section 40*a* is the so-called in-body discharge section of the image forming apparatus 101, and is comprised of space partitioned by a stand face 1*a*, ceiling face 1*b* and placement face 41 of the apparatus housing 1.

The second discharge section 40*b* is a discharge section using the sheet placement face 71*a* that is the top face of the unit housing of the post-processing unit 70, and is to discharge straight the sheet subjected to the image forming processing in the image forming section 21 face up, or to reverse the side of the sheet with the sheet reverse path P3 to discharge face down. In other words, it is possible to discharge to both the first discharge section 40*a* and the second discharge section 40*b* according to setting of a user, and in consideration of productivity, it is desirable to discharge to the first discharge section 40*a* in the case of face-down, and to discharge to the second discharge section 40*b* in the case of face-up.

Further, it is also possible to allocate the sheet to discharge to the first discharge section 40*a* or to discharge to the second discharge section 40*b*, corresponding to an amount (e.g., based on information on an image ratio described later) of ink attached to the sheet by the image forming processing in the image forming section 21. For example, in the case where the image ratio is low, since it is not necessary to dry the ink attached to the sheet, as described above, the sheet is discharged to the first discharge section 40*a* in the case of face-down, while being discharged to the second discharge section 40*b* in the case of face-up without any processing. However, in the case where the image ratio is high, since it is necessary to dry the ink attached to the sheet, the sheet is once transported to the sheet reverse path P3 to earn time, and is thereby dried. After transporting the sheet to the sheet reverse path P3, the face-up sheet is discharged to the first discharge section 40*a*, and the face-down sheet is discharged to the second discharge section 40*b*. In addition, by providing the sheet reverse path P3 with a drying member such as a fan, it is possible to improve a drying effect more.

The third discharge section 40*c* is the stack tray 171 of the post-processing unit 70, and the sheet subjected to the post-processing in the post-processing unit 70 is discharged to the section 40*c*. The stack tray 171 is configured to be able to move up and down, and corresponding to a sheet load amount, moves up and down. Since the post-processing unit 70 of this Embodiment has the mechanism for shifting the sheet in the width direction, also when the staple binding processing is not performed, it is possible to discharge in a state in which the sheet is shifted in the width direction on the stack tray 171.

In addition, in this Embodiment, the processing described later by the post-processing unit 70 is performed based on information on the image ratio. However, for example, it may also be configured to discharge, to the first discharge section 40*a* or the second discharge section 40*b*, a sheet (e.g., a sheet with an entire surface solid image of thick color, etc. printed) with an image formed in a high image ratio exceeding limitations of a range suitable for the processing in the post-processing unit 70.

Further, in the case of performing the post-processing in the post-processing unit 70, productivity decreases as compared with straight discharge. Accordingly, also in the case of executing a mode with importance placed on productivity, it may be configured to discharge to the first discharge section 40*a* or the second discharge section 40*b*.

[Control Configuration]

Figure 3:
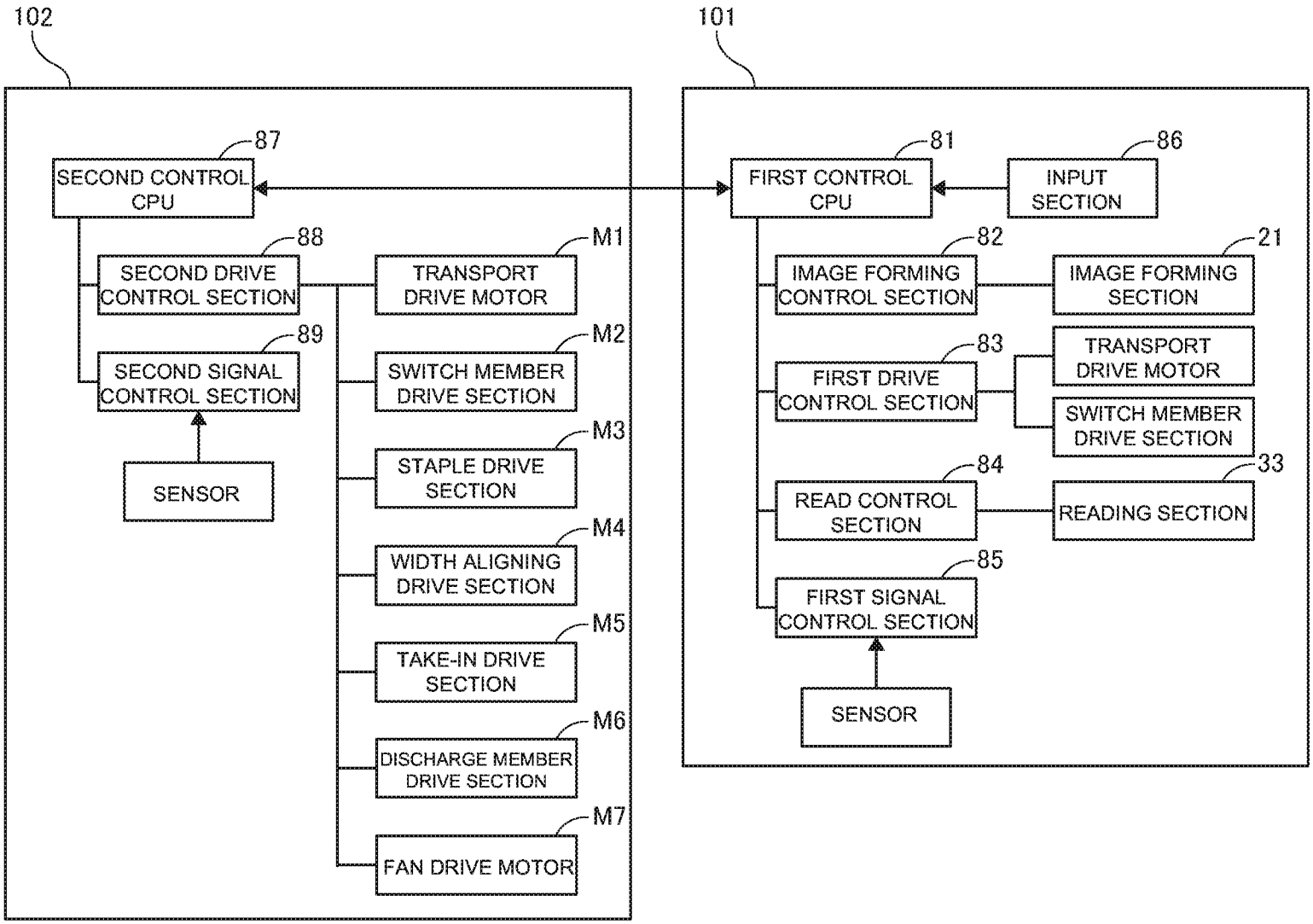
FIG. 3 is a block diagram illustrating a control configuration of Embodiment 1.

FIG. 3 is a diagram illustrating a control configuration of the image forming system 100 of this Embodiment. The image forming apparatus 101 and sheet processing apparatus 102 have control CPUs 81, 87, respectively, and are capable of communicating information with each other. The first control CPU 81 of the image forming apparatus 101 is connected to an image forming control section 82, first drive control section 83, read control section 84, and first signal control section 85. The read control section 84 acquires image data read by the image reading section 33 of the image reading unit 30 to output to the first control CPU 81 as printing data. The first control CPU 81 sends the printing data received from the read control section 84 to the image forming control section 82, and the image forming control section 82 controls the image forming section 21 to perform the image forming processing. Further, the first control CPU 81 outputs a command to the first drive control section 83, corresponding to input information (detection of a sheet end portion, etc.) from various sensors connected to the first signal control section 85, and controls a transport drive motor of rollers to transport the sheet and switch member drive section to transport the sheet. Furthermore, the first control CPU 81 is connected to the input section 86 for the user to input information on a printing mode, discharge mode, post-processing mode and the like, and corresponding to the input information, controls each control section, while transmitting the mode information to the second control CPU 87 of the sheet processing apparatus 102.

The user sets "image forming mode" and "post-processing mode" from the input section 86. The image forming mode is set for mode setting such as color or monochrome printing and two-side or one-side printing, and image forming conditions such as a sheet size, sheet type (weighing, material and the like of a sheet), the number of printout copies, and enlarged or reduced printing. Further, the "post-processing mode" is set for "printout mode", "staple binding processing mode", "eco-binding processing mode", "jog sorting mode" and the like. In addition, the sheet processing apparatus 102 shown in the figure is provided with a "manual binding mode", and this mode is to execute binding processing operation of a sheet bunch offline, independently of the first control CPU 81 of the image forming apparatus 101.

The second control CPU 87 of the sheet processing apparatus 102 is provided in the post-processing unit 70, and as well as the post-processing unit 70, also controls operation of the relay transport unit 60. The second control CPU 87 is connected to a second drive control section 88 and second signal control section 89, and corresponding to input information (detection of a sheet end portion, etc.) from various sensors connected to the second signal control section 89, outputs a command to the second drive control section 88 to control operation of the sheet processing apparatus 102. Based on the command from the second control CPU 87, the second drive control section 88 controls a transport drive motor M1 for driving rollers to transport the sheet, and a switch member drive section M2 disposed in the path switch section 61 of the relay transport unit 60 to drive the switch section, and thereby transports the sheet. Further, the second drive control section 88 is also connected to a staple drive section M3 for driving the staple binding processing section 76, a width aligning drive section M4 for driving the width aligning member 79, a take-in drive section M5 for driving the paddle 75*a* and knurl belt 75*b*, a discharge member drive section M6 for driving the bunch discharge member 78, and a fan drive motor M7 for driving a fan 91 described later, and by controlling these drive sections, causes the post-processing section 70 to execute post-processing operation.

Further, the first control CPU 81 transfers, to the second control CPU 87, data on the post-processing mode, number-of-sheet information (the number of sheets for bunch formation), number-of-copy information, sheet type information on the size, thickness and the like of the sheet to form an image, and the like. In addition thereto, the first control CPU 81 transfers a job end signal to the second control CPU 87 whenever the image forming processing is finished. Further, in this Embodiment, the first control CPU 81 transfers, to the second control CPU 87, printing information, particularly, information (e.g., a discharge amount of ink) on the image ratio of the sheet. As well as the information on the image ratio of the sheet, the printing information includes image information read with the image reading unit 30, or an ink discharge amount calculated from the image information, and the like.

Herein, the "image ratio (print ratio)" is a ratio of an area of a region where an image is formed to an area of the entire image-formable region of a sheet. For example, in the entire surface solid image to form, on a sheet, a maximum concentration of image in the entire image-formable region by the image forming section 21, the image ratio is 100%. In the case of the inkjet type of image forming apparatus, when the image ratio is high, an amount of ink is also large to use in the image formed on the sheet. In addition, in the following description, the type of information is not particularly limited about the information on the image ratio used in control of operation based on the image ratio. As examples of the information on the image ratio, there are a count value for totaling discharge amounts of ink in the inkjet type, and a count value (video count value) for totaling signals for designating the presence or absence of a dot for each pixel in the electrophotographic type.

In addition, for example, when image formation is performed using the inkjet type, in the case where the image ratio is high, there is a possibility that stiffness of the sheet decreases, while weight increases, and that coefficients of friction on other members, sheet and like increase (even when the sheet weight is the same after image formation, since an amount of ink attached to the sheet is large in the sheet with a high image ratio, the coefficient of friction increases. In other words, in the sheet of the same size, there are a thick sheet with a low image ratio and a thin sheet with a high image ratio, and even when the sheet weight is the same after image formation, there is the risk that a discharge defect occurs in the thin sheet with the high image ratio due to an increase in the coefficient of friction.) Therefore, with respect to the sheet with the high image ratio, in the case of forming a sheet bunch to perform the post-processing on the processing tray 74, and then, discharging to the stack tray 171, significant friction occurs between the bunch and the top face of the stack tray 171, or between the bunch and sheets already stacked on the stack tray 171. Further, since the weight of the sheet bunch is heavy and stiffness is low, the sheet bunch comes into contact with the stack tray 171 from immediately near the processing tray 74, and as compared with the case of a sheet bunch high in stiffness, the contact area with the stack tray 171 is increased. Also by this means, significant friction occurs between the sheet bunch and the top face of the stack tray 171, or between the sheet bunch and the sheets already stacked on the stack tray 171. In the sheet with the high image ratio, since stiffness is low, when slide resistance is high, there is a possibility that it is not possible to transport the sheet bunch and that the sheet bunch is curved upward, and there is the risk that a discharge defect of the sheet bunch occurs. Therefore, in this Embodiment, in the case where the image ratio is high, by floating the sheet bunch from the stack tray 171 by the air blowing apparatus 90, it is configured to decrease a contact area with the top face of the stack tray 171 or the sheets stacked on stack tray 171 to thereby suppress the discharge defect of the sheet bunch.

[Air Blowing Apparatus]

The air blowing apparatus 90 as an air blowing means that is a characteristic configuration of this Embodiment will be described next in detail. As shown in FIG. 2, the air blowing apparatus 90 is disposed between the processing tray 74 and the stack tray 171 inside the unit housing 71, and has a fan 91, duct portion 92, nozzle portion 93, and blowoff portion 94.

The air blowing apparatus 90 is configured to be able to blow air toward the downstream side in the transport direction, from between the downstream-side end portion of the processing tray 74 and the upstream-side end portion of the stack tray 171.

The fan 91 is driven by the fan drive motor M7 (see FIG. 3), based on a command signal from the second control CPU 87 (see FIG. 3), and is provided, for example, on the bottom inside the unit housing 71. By driving, the fan 91 sucks in air from a suction inlet 71*b* provided in the bottom of the unit housing 71, and blows out to the duct portion 92 provided toward above.

The duct portion 92 is provided with the vertical direction being a flow channel, the fan 91 is disposed in a lower portion, and the nozzle portion 93 is continued to an upper end portion. In this Embodiment, the duct portion 92 is formed so that the flow channel is narrower in the upper portion than in the lower portion with respect to the upstream-downstream direction in the sheet transport direction. The nozzle portion 93 is provided with the flow channel inclined in the direction in which the downstream side in the sheet transport direction is the upper side from the uppermost portion of the duct portion 92. The nozzle portion 93 is opened in a position opposed to between the processing tray 74 of the unit housing 71 and the stack tray 171, and the opening forms the blowoff portion 94. In addition, it is possible to configure the inclined angle of the nozzle portion 93 as appropriate, and as well as the arrangement with the discharge side inclined upward as in this Embodiment, it may be also possible to make a horizontal arrangement and an arraignment with the discharge side inclined downward.

Figure 5A:
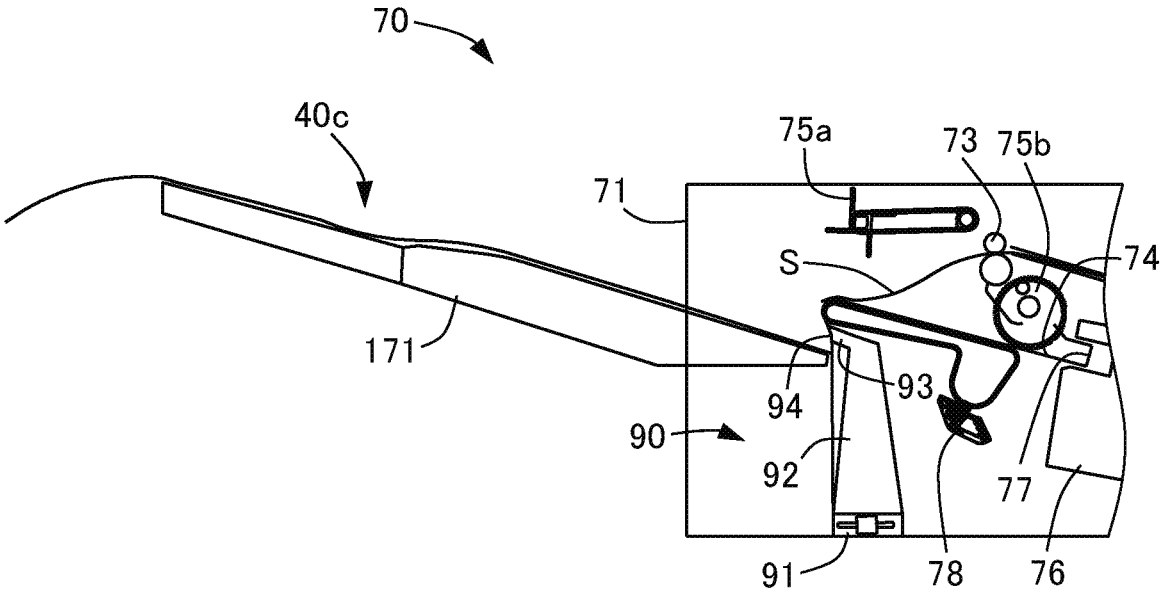
FIGS. 5A and 5B contain views to explain operation of an air blowing apparatus by the post-processing unit of Embodiment 1, where

Operation of the air blowing apparatus 90 will be described with reference to FIGS. 5A, 5B, and FIGS. 6A and 6B. In addition, in FIGS. 5A to 6B, in order to make the sheet S easy to see, the width aligning member 79 is not shown in the figure to omit. As shown in FIG. 5A, the sheet S is delivered to the post-processing unit 70 from the relay transport unit 60, and the front end portion of the sheet S arrives at the processing tray 74 by the discharge roller 73.

Figure 5B:
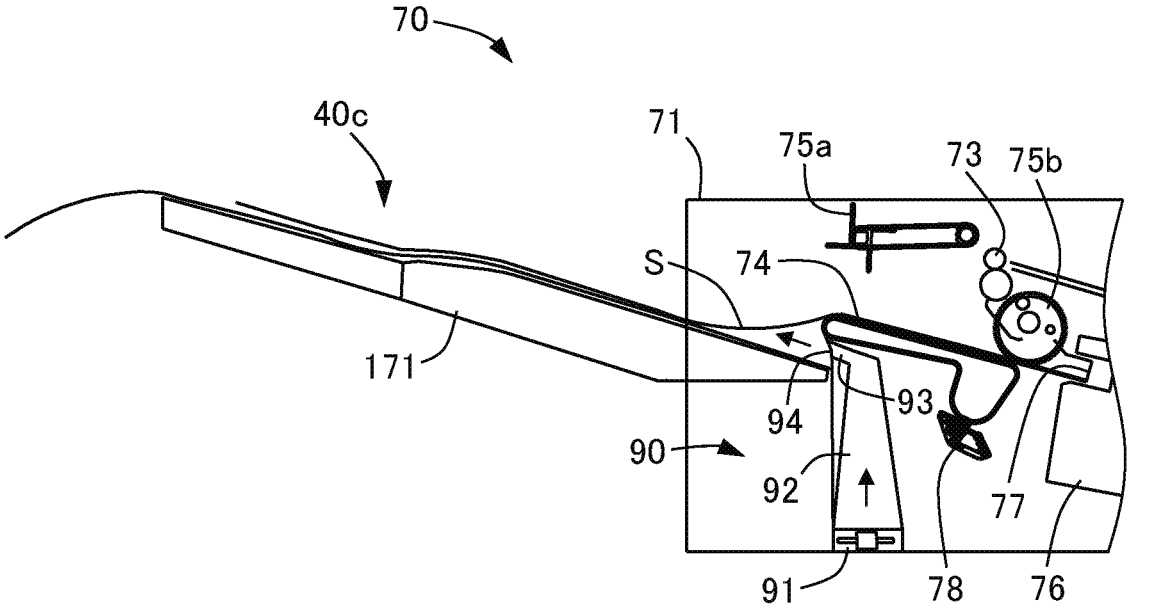

Then, as shown in FIG. 5B, the sheet S is placed over the stack tray 171 from the processing tray 74, and the paddle 75*a* and knurl belt 75*b* move down to the actuation positions to shift the sheet S in the direction opposite to the transport direction until the sheet S comes into contact with the sheet end regulating member 77. After brining the rear end of the sheet S into contact with the sheet end regulating member 77 by the paddle 75*a* and knurl belt 75*b*, the paddle 75*a* and knurl belt 75*b* are moved up, and the width aligning member 79 performs aligning operation in the sheet width direction. Herein, the second control CPU 87 drives the fan 91 to start blowing air.

Figure 6A:
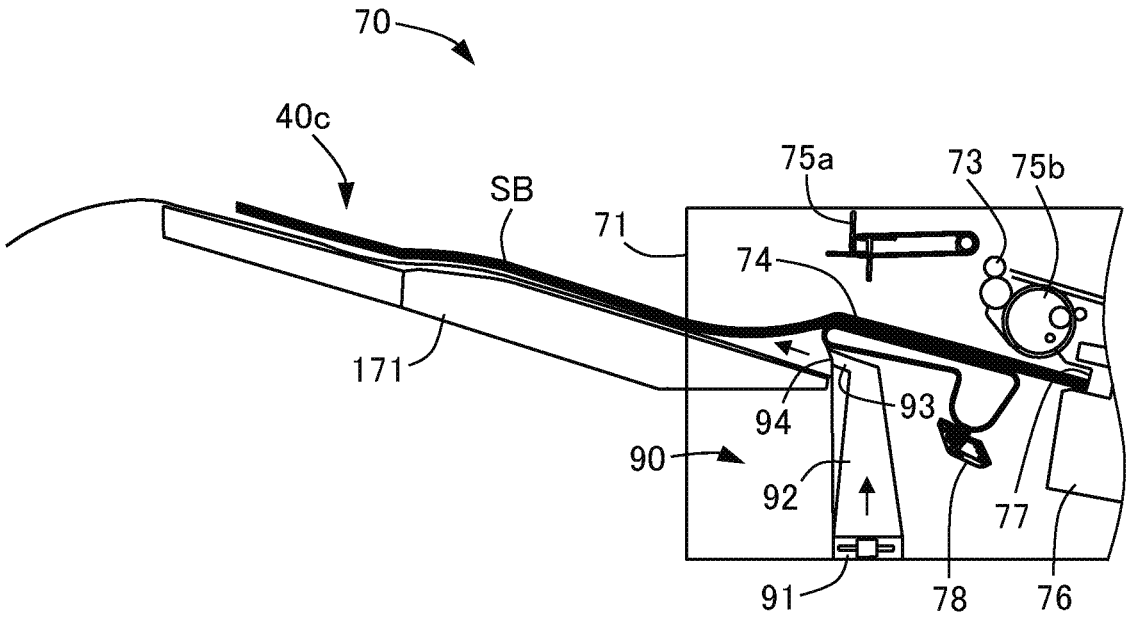
FIGS. 6A and 6B contain views to explain operation of the air blowing apparatus by the post-processing unit of Embodiment 1, where

Subsequently, the sheet is sequentially discharged from the discharge roller 73, as shown in FIG. 6A, a sheet bunch SB brought into contact with the sheet end regulating member 77 is formed, and the staple binding processing section 76 binds a predetermined position of the sheet bunch SB. Then, the bunch discharge member 78 comes into contact with the rear end portion of the sheet bunch SB, and pushes out the sheet bunch SB subjected to the binding processing to the stack tray 171. At this point, since the fan 91 is driven, the sheet bunch SB on the stack tray 171 floats on the side close to the processing tray 74 of the stack tray 171 (or sheets already placed on the stack tray 171), a contact area of the sheet bunch SB is decreased with respect to the stack tray 171, and it is possible to reduce slide resistance. Accordingly, in discharging the sheet from the processing tray 74 to the stack tray 171, even when slide characteristics are poor, it is possible to suppress a discharge defect, and to actualize smooth discharge.

Figure 6B:
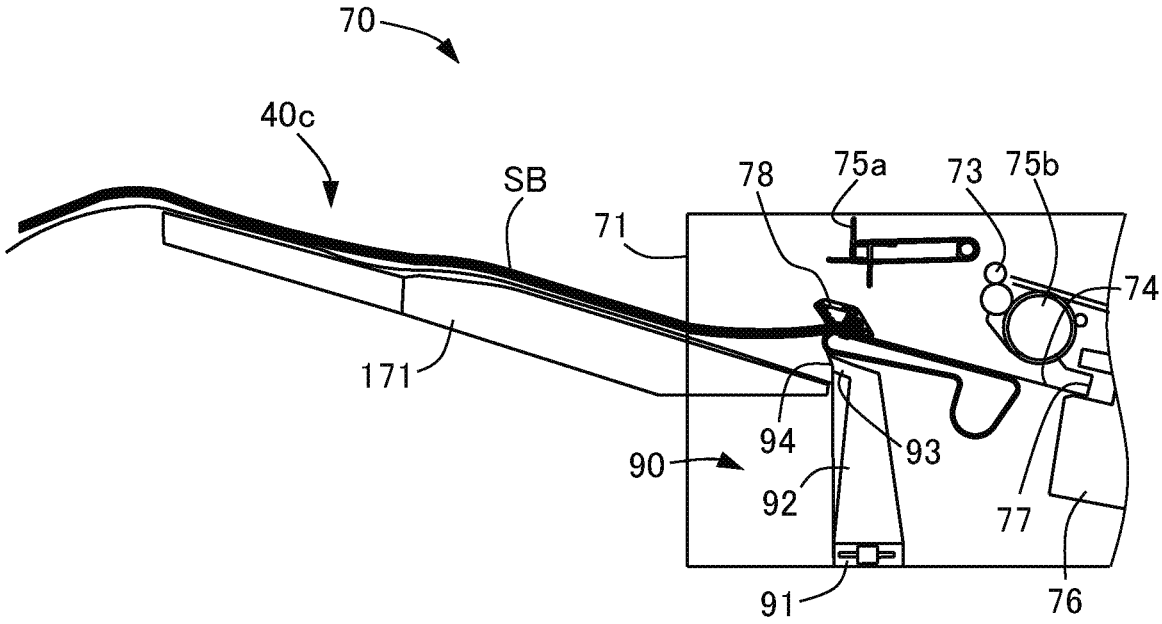

Then, as shown in FIG. 6B, the sheet bunch SB is further pushed out, and immediately before the upstream end of the sheet bunch SB in the transport direction shifts from the processing tray 74 to the stack tray 171, the air blow of the air blowing apparatus 90 is halted. In other words, the air blowing apparatus 90 halts the air blow before the upstream side of the sheet transported from the processing tray 74 to the stack tray 171 by the bunch discharge member 78 arrives at the downstream-side end portion of the processing tray 74. Herein, in the case where the air blow is continued from the air blowing apparatus 90 even after the upstream end of the sheet shifts to the downstream side of the downstream-side end portion of the processing tray 74, when the upstream end of the sheet bunch SB tries to drop onto the stack tray 171, there is a possibility that the sheet bunch SB is blown up by the air blow and is not able to drop. In contrast thereto, in this Embodiment, since the air blow is halted, the upstream end of the sheet bunch SB is capable of dropping onto the stack tray 171, and is discharged to the stack tray 171. In addition, as timing for halting the air blow by the air blowing apparatus 90, for example, the air blow is halted after a lapse of predetermined time since drive of the bunch discharge member 78 is started by the discharge member drive section M6, using a timer. Alternatively, by providing a sensor capable of detecting that the rear end portion of the sheet bunch SB passes through a predetermined position of the processing tray 74, it is possible to halt the air blow based on detection of passage of the rear end portion of the sheet bunch SB by this sensor. In addition, as a matter of course, the timing for halting the air blow by the air blowing apparatus 90 is not limited to these examples.

An air quantity blown from the air blowing apparatus 90 will be described next in detail. For example, when the air blowing apparatus 90 is configured to always blow air with an air quantity suitable for a sheet bunch comprised of sheets with the image ratio being the maximum value, the air quantity is excessively large with respect to a sheet bunch comprised of sheets with a low image ratio, and there is a possibility that an adverse effect occurs such that the sheet bunch flows to the downstream side on the stack tray 171. Therefore, in this Embodiment, it is configured that the second control CPU 87 changes an air quantity of the air blowing apparatus 90 based on an image ratio of an image formed on a sheet. For example, in the case where a threshold of the image ratio is 70%, the air blowing apparatus 90 sets an air quantity to blow to the sheet at a first air quantity F1 when the image ratio is a first value F1 (e.g., a value less than 70%), while setting the air quantity to blow to the sheet at a second air quantity F2 larger than the first air quantity F1 when the image ratio is a second value (e.g., a value of 70% or more) higher than the first value.

Thus, since friction resistance of a sheet is not so high when the image ratio is the relatively low first value, and therefore, when the air quantity is too large, there is the risk that the sheet bunch SB flows to the downstream side on the stack tray 171. Then, in this case, the air quantity to blow to the sheet is set at the relatively small first air quantity F1, and air is blown to the extent that excessive air is not blown to the sheet bunch SB so as to float from the stack tray 171 by a proper amount. On the other hand, friction resistance of a sheet is high when the image ratio is the relatively high second value, and therefore, when the air quantity is too small, a float amount lacks not to enable slide resistance to be reduced sufficiently. Then, in this case, the air quantity to blow to the sheet is set at the relatively large second air quantity F2, and air is sufficiently blown to the sheet bunch SB to adequately float from the stack tray 171. By this means, it is possible to blow air with a proper air quantity corresponding to weight and friction resistance of the sheet bunch, and it is thereby possible to suppress the discharge effect more suitably, and actualize smooth discharge.

In addition, in this Embodiment, since the shapes of the duct portion 92 and nozzle portion 93 of the air blowing apparatus 90 are not changed, the air quantity is correlated with air velocity. Further, the transport velocity of the sheet and halt time is not changed to change the air quantity. In other words, the flow time is certain. Accordingly, in this Embodiment, the second control CPU 87 only changes the rotation velocity of the fan drive motor M7 of the fan 91 to change the air quantity.

Figure 7:
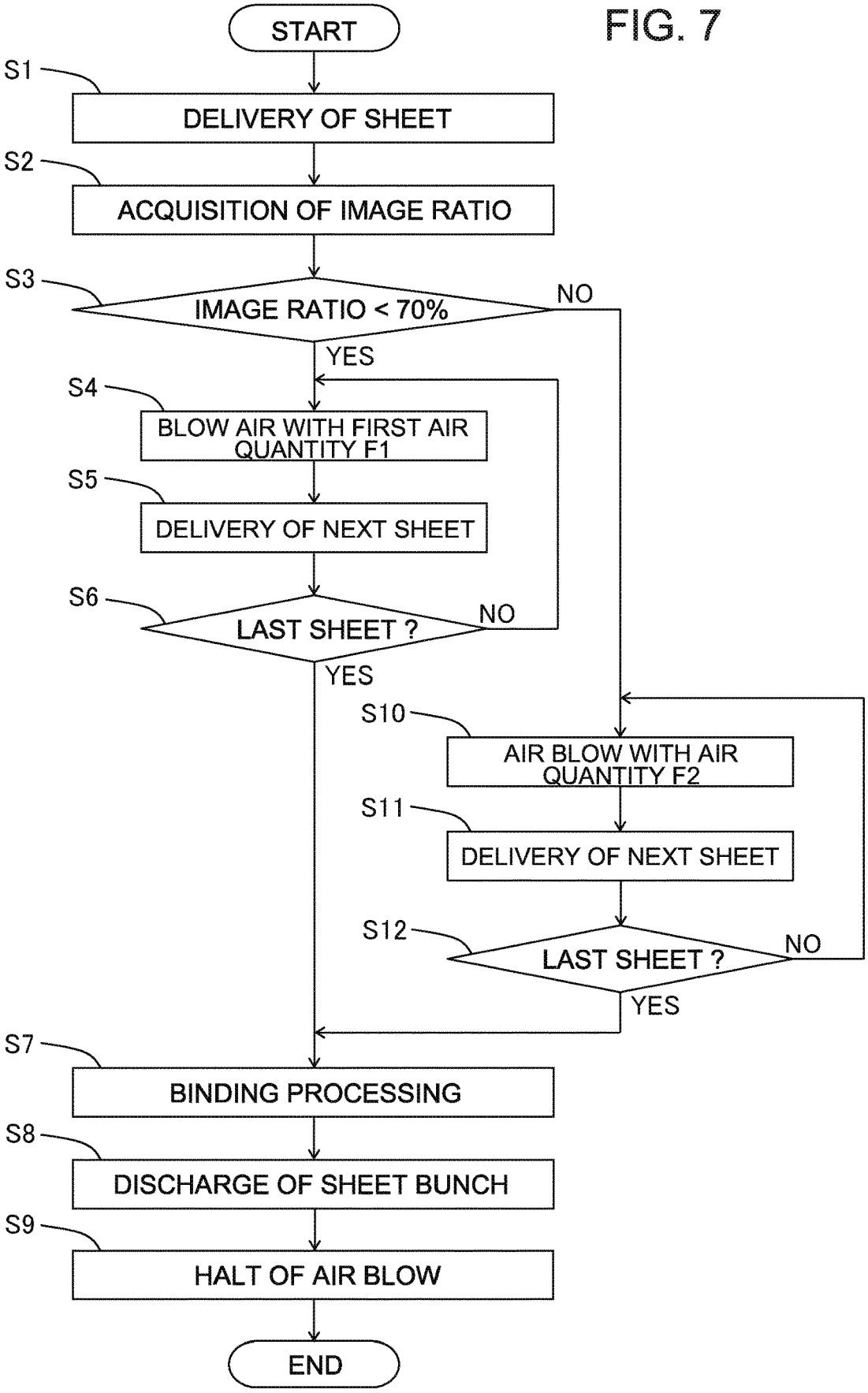
FIG. 7 is a flowchart illustrating a procedure of operation of the air blowing apparatus of Embodiment 1.

Next, a procedure will be described in detail in the case of executing air blowing processing using the air blowing apparatus 90 after image formation in the image forming system 100 of this Embodiment, according to a flowchart shown in FIG. 7. Herein, the case will be described where a plurality of sheets with images formed by the image forming apparatus 100 is made a sheet bunch, and is subjected to the binding processing by the sheet processing apparatus 102. After forming an image in the image forming apparatus 101, the image-formed sheet is delivered to the post-processing unit 70 from the relay transport unit 60 on a sheet-by-sheet basis (step S1), and the front end portion of the sheet S arrives at the processing tray 74 by the discharge roller 73 (see FIG. 5A). The second control CPU 87 of the sheet processing apparatus 102 acquires an image ratio of the sheet sent from the image forming apparatus 101 (step S2).

The second control CPU 87 determines whether or not the image ratio is less than 70% (step S3). In the case where the second control CPU 87 determines that the image ratio is less than 70% (YES in step S3), the CPU 87 determines that the image ratio is low, and sets the air quantity from the air blowing apparatus 90 at the first air quantity F1 to blow air (step S4). In other words, air is blown with a small air quantity so as not to blow the sheet bunch SB on the stack tray 171 excessively to the downstream side. Then, the second control CPU 87 shifts the sheet to the sheet end regulating member 77 by the paddle 75*a* and knurl belt 75*b*, and receives the next sheet from the image forming apparatus 101 (step S5). The second control CPU 87 determines whether or not the received sheet is the last sheet to form a sheet bunch (step S6). In the case where the second control CPU 87 determines that the received sheet is not the last sheet to form a sheet bunch (NO in step S6), while continuing the air blow with the first air quantity F1 (step S4), the CPU 87 receives the further next sheet from the image forming apparatus 101 (step S5).

In the case where the second control CPU 87 determines that the received sheet is the last sheet to form a sheet bunch (YES in step S6), the CPU 87 executes the binding processing by the staple binding processing section 76 (step S7). Then, the second control CPU 87 drives the bunch discharge member 78 to discharge the sheet bunch subjected to the binding processing from the processing tray 74 to the stack tray 171 (step S8), and immediately before the upstream end of the sheet bunch SB in the transport direction shifts from the processing tray 74 to the stack tray 171, halts the air blow from the air blowing apparatus 90 (step S9).

On the other hand, in the case where the second control CPU 87 determines that the image ratio is not less than 70% (NO in step S3), the CPU 87 determines that the image ratio is high, and sets the air quantity from the air blowing apparatus 90 at the second air quantity F2 to blow air (step S10). In other words, air is blown with a large air quantity so as to sufficiently float the sheet bunch SB on the stack tray 171. Then, the second control CPU 87 shifts the sheet to the sheet end regulating member 77 by the paddle 75*a* and knurl belt 75*b*, and receives the next sheet from the image forming apparatus 101 (step S11). The second control CPU 87 determines whether or not the received sheet is the last sheet to form a sheet bunch (step S12). In the case where the second control CPU 87 determines that the received sheet is not the last sheet to form a sheet bunch (NO in step S2), while continuing the air blow with the second air quantity F2 (step S10), the CPU 87 receives the further next sheet from the image forming apparatus 101 (step S11). Further, in the case where the second control CPU 87 determines that the received sheet is the last sheet to form a sheet bunch (YES in step S12), the CPU 87 executes the binding processing and subsequent processing in the same manner as described above (steps S7 to S9).

As described above, according to the sheet processing apparatus 102 of this Embodiment, in pushing out the sheet bunch SB subsequent to the binding processing to the stack tray 171, since the fan 91 is driven, the sheet bunch SB on the stack tray 171 floats on the side close to the processing tray 74 of the stack tray 171 (or sheets already placed on the stack tray 171), a contact area of the sheet bunch SB is decreased with respect to the stack tray 171, and it is possible to reduce slide resistance. Accordingly, in discharging the sheet from the processing tray 74 to the stack tray 171, even when slide characteristics are poor, it is possible to suppress a discharge defect, and to actualize smooth discharge.

Further, according to the sheet processing apparatus 102 of this Embodiment, the air blowing apparatus 90 sets an air quantity to blow to the sheet at the first air quantity F1 (including air quantity of 0) when the image ratio is a first value (e.g., a value less than 70%). Further, the apparatus 90 sets an air quantity to blow to the sheet at the second air quantity F2 larger than the first air quantity F1 when the image ratio is a second value (e.g., a value of 70% or more) higher than the first value. By this means, it is possible to blow air with the proper air quantity corresponding to weight and friction resistance of a sheet bunch, and it is thereby possible to suppress the discharge defect more suitably. In other words, in discharging the sheet from the processing tray 74 to the stack tray 171, also in the case where a coefficient of friction varies according to an image ratio of an image formed on a sheet, it is possible to properly suppress the discharge defect corresponding to the image ratio of the sheet.

Embodiment 2

Embodiment 2 will be described next in detail with reference to FIG. 8. This Embodiment differs in configuration from Embodiment 1, in the respect that the nozzle portion 93 of the air blowing apparatus 90 has a wind direction changing portion 95 as a wind direction changing means for enabling an air blow direction from the air blowing apparatus 90 to be changed. In addition, components except the portion 95 are the same as in Embodiment 1, and the same reference numerals are assigned to omit detailed descriptions.

The wind direction changing portion 95 has a fin 96, a rotation shaft 97 for rotating the fin 96 and a drive motor not shown to rotate the rotation shaft 97. The rotation shaft 97 is provided rotatably substantially in the center portion of the nozzle portion 93 with the width direction orthogonal to the transport direction being the longitudinal direction. The fin 96 is in the form of a plate with the width direction orthogonal to the transport direction being the longitudinal direction, and is provided to enable a flow channel of air passing inside the nozzle portion 93 to be changed in the vertical direction, by changing the direction by rotation of the rotation shaft 97. The drive motor is driven by the second control CPU 87.

Figure 8:
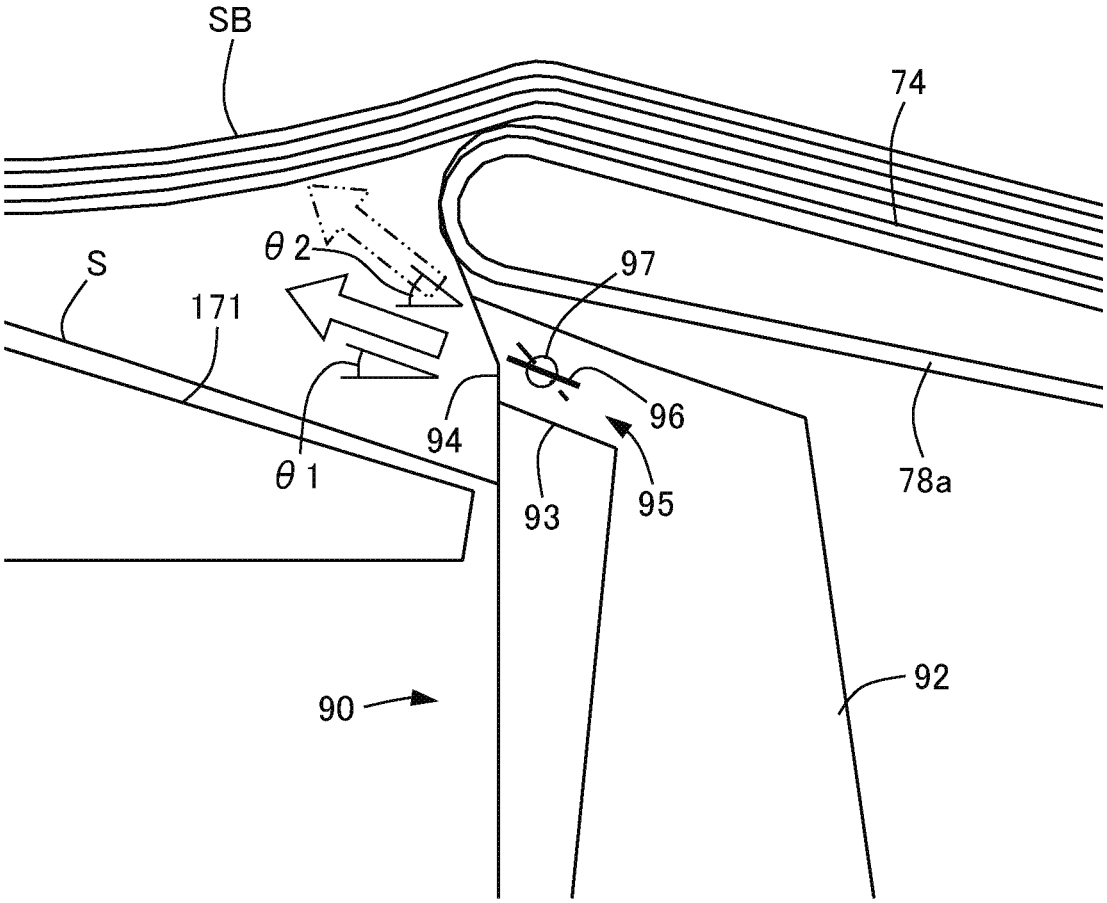
FIG. 8 is a schematic view obtained by enlarging an air blowing apparatus of a post-processing unit of Embodiment 2.

In this Embodiment, when the image ratio of the image formed on the sheet delivered to the sheet processing apparatus 102 is a first value, the wind direction changing section 95 sets the air blow direction to the sheet by the air blowing apparatus 90 at a direction inclined a first angle θ1 with respect to the horizontal direction (arrow of solid line in FIG. 8). Further, when the image ratio of the image formed on the sheet delivered to the sheet processing apparatus 102 is a second value higher than the first value, the wind direction changing section 95 sets the air blow direction to the sheet by the air blowing apparatus 90 at a direction inclined a second angle θ2 larger than the first angle θ1 with respect to the horizontal direction (arrow of phantom line in FIG. 8).

Thus, since friction resistance of a sheet is not so high when the image ratio is the relatively low first value, and therefore, when the inclined angle in the air blow direction is too large, there is the risk that the sheet bunch SB excessively floats from the stack tray 171 and flows to the downstream side. Then, in this case, the inclined angle in the air blow direction to blow to the sheet is set at the relatively small first angle θ1, and air is blown to the extent that the sheet bunch SB does excessively not float so as to float from the stack tray 171 by a proper amount. On the other hand, friction resistance of a sheet is high when the image ratio is the relatively high second value, and therefore, when the inclined angle in the air blow direction is too small, a float amount lacks not to enable slide resistance to be reduced sufficiently. Then, in this case, the inclined angle in the air blow direction to blow to the sheet is set at the relatively large second inclined angle θ2, and air is sufficiently blown to the sheet bunch SB to adequately float from the stack tray 171. By this means, it is possible to blow air in a proper air blow direction corresponding to weight and friction resistance of the sheet bunch, and it is thereby possible to suppress the discharge effect more suitably, and actualize smooth discharge.

As described above, according to the sheet processing apparatus 102 of this Embodiment, when the image ratio of the image formed on the sheet delivered to the sheet processing apparatus 102 is the first value, the wind direction changing section 95 sets the air blow direction to the sheet by the air blowing apparatus 90 at the direction inclined the first angle θ1 with respect to the horizontal direction (arrow of solid line in FIG. 8). Further, when the image ratio of the image formed on the sheet delivered to the sheet processing apparatus 102 is the second value higher than the first value, the wind direction changing section 95 sets the air blow direction to the sheet by the air blowing apparatus 90 at the direction inclined the second angle θ2 larger than the first angle θ1 with respect to the horizontal direction (arrow of phantom line in FIG. 8). By this means, it is possible to blow air in the proper air blow direction corresponding to weight and friction resistance of a sheet bunch, and it is thereby possible to suppress the discharge defect more suitably. In other words, in discharging the sheet from the processing tray 74 to the stack tray 171, also in the case where a coefficient of friction varies according to an image ratio of an image formed on a sheet, it is possible to properly suppress the discharge defect corresponding to the image ratio of the sheet.

Other Embodiments

In addition, in the sheet processing apparatus 102 in each of the above-mentioned Embodiments, the case is described where the air blow from the air blowing apparatus 90 is halted immediately before the upstream end of the sheet bunch SB in the transport direction shifts from the processing tray 74 to the stack tray 171, but the invention is not limited to a halt of the air blow. For example, instead of halting the air blow immediately before the upstream end of the sheet bunch SB in the transport direction shifts from the processing tray 74 to the stack tray 171, the air quantity to blow may be set at an air quantity smaller than the previous air quantity.

Further, in the sheet processing apparatus 102 in each of the above-mentioned Embodiments, the case is described where the image ratio is transmitted from the first control CPU 81 of the image forming apparatus 101 to the second control CPU 87 of the sheet processing apparatus 102, but the invention is not limited thereto. For example, the image forming apparatus 101 or the sheet processing apparatus 102 is provided with an image sensor such as CIS for reading an image of a sheet subjected to image formation, and may acquire an image ratio based on a value read with the image sensor. In this case, for example, even in the case where the first control CPU 81 does not have information on an image ratio, it is possible to acquire the image ratio, or it is possible to acquire the image ratio based on the actually formed image. The image sensor is provided on the transport path P5 (between the sheet supply opening 72 and the discharge roller 73) of the sheet processing apparatus 102, and reads an image of a sheet transported on the transport path P5.

Furthermore, in the sheet processing apparatus 102 in each of the above-mentioned Embodiments, the case is described where 70% is applied as a threshold of the image ratio, and the air quantity is varied based on whether or not the image ratio is less than 70%, but the invention is not limited thereto. For example, the threshold is not limited to 70%, and for example, may be an appropriate value between 60% and 80%. Alternatively, the threshold is not limited one. For example, two large and small thresholds are provided, and by sorting to three stages such as the case where the image ratio is smaller than the small threshold, the case where the image ratio is between two thresholds, and the case where the image ratio is larger than the large threshold, respective different air quantities may be set. The number of stages may be "4" or more, or the threshold may change linearly without having stages. Still furthermore, in the sheet processing apparatus 102 in each of the above-mentioned Embodiments, the case is described where air is blown with the small first air quantity F1 in the case where the image ratio is less than 70%, but the invention is not limited thereto. For example, the air blow may be halted in the case where the image ratio is less than 70%.

In addition, a part of the processing executed by the second control CPU 87 in the above-mentioned Embodiment may be performed by a processor installed in a housing different from the housing installed with the first stacking section, such as the first control CPU 81 of the image forming apparatus 101. Particularly, such a form may be made where the first control CPU 81 of the image forming apparatus 101 calculates an air quantity to blow from the air blowing apparatus 90 based on information on the image ratio, transmits the result to the second control CPU 87, and does not transmit the information on the image ratio to the second control CPU 87. The "sheet stacking apparatus" in such a form refers to an apparatus provided with an apparatus body provided with a mechanical configuration (processing tray 74, stack tray 171, etc.) to stack sheets, and elements (processor, storage apparatus, etc.) connected to the apparatus body electrically to constitute a control circuit to operate the apparatus body.

In addition, it is possible to actualize the present invention by processing where a program for actualizing one or more functions of the above-mentioned Embodiments is supplied to a system or apparatus via a network or storage medium, and one or more processors in a computer of the system or apparatus read the program to execute. Further, it is possible to actualize the invention also by a circuit (e.g., ASIC) for actualizing one or more functions.

Further, the air quantity from the air blowing apparatus 90 may be changed corresponding to whether the sheet discharged to the stack tray 171 is one-side printing or two-side printing. In this case, even in the same image ratio, it is desirable to make the air quantity from the air blowing apparatus 90 larger in two-side printing than in one-side printing. Furthermore, also in the case of one-side printing, when the sheet on the stack tray is face up, and the sheet to be discharged subsequently is discharged face down, since the print surfaces contact each other, even in the same image ratio, it is desirable to increase the air quantity of the air blowing apparatus 90 as compared with the case where face-up or face-down is continued.

The invention claimed is:

1. A sheet stacking apparatus for stacking sheets with images formed in an image forming apparatus, comprising:

a first stacking section adapted to enable a sheet to be stacked;

a discharge section adapted to discharge the sheet with an image formed in the image forming apparatus to the first stacking section;

a transport section adapted to transport the sheet stacked on the first stacking section in a predetermined transport direction;

a second stacking section adapted to enable the sheet transported from the first stacking section by the transport section to be stacked, the second stacking section having an upstream side end portion in the transport direction disposed lower in a vertical direction than a downstream-side end portion of the first stacking section in the transport direction;

a determination section adapted to determine whether an image ratio on the sheet formed by the image forming apparatus is a first value or a second value greater than the first value; and an air blowing section adapted to enable air to be blown toward a downstream side in the transport direction from between the downstream-side end portion of the first stacking section and the upstream-side end portion of the second stacking section so that when the image ratio of the image determined by the determination section is the first value, the air blowing section sets an air quantity blown to the sheet at a first air quantity, while when the image ratio is the second value, setting the air quantity blown to the sheet at a second air quantity larger than the first air quantity.

2. A sheet stacking apparatus for stacking sheets with images formed in an image forming apparatus, comprising:

a first stacking section adapted to enable a sheet to be stacked;

a discharge section adapted to discharge the sheet with an image formed in the image forming apparatus to the first stacking section;

a transport section adapted to transport the sheet stacked on the first stacking section in a predetermined transport direction;

a second stacking section adapted to enable the sheet transported from the first stacking section by the transport section to be stacked, the second stacking section having an upstream side end portion in the transport direction disposed lower in a vertical direction than a downstream-side end portion of the first stacking section in the transport direction;

an air blowing section adapted to enable air to be blown toward a downstream side in the transport direction from between the downstream-side end portion of the first stacking section and Drill the upstream-side end portion of the second stacking section; and a wind direction changing section adapted to enable an air blow direction from the air blowing section to be changed, wherein when an image ratio of the image formed on the sheet by the image forming apparatus is a first value, the wind direction changing section sets the air blow direction to the sheet by the air blowing section at a direction inclined a first angle with respect to a horizontal direction, while when the image ratio is a second value higher than the first value, setting the air blow direction to the sheet by the air blowing section at a direction inclined a second angle larger than the first angle with respect to the horizontal direction.

3. The sheet stacking apparatus according to claim 1, further comprising:

an aligning member adapted to be able to shift in a width direction orthogonal to the transport direction of the sheet by the discharge section and come into contact with a side end in the width direction of the sheet discharged to the first stacking section by the discharge section to align, wherein the air blowing section starts to blow air after the sheet discharged to the first stacking section is aligned in the width direction by the aligning member.

4. The sheet stacking apparatus according to claim 1, wherein the air blowing section halts an air blow before the upstream end of the sheet transported from the first stacking section to the second stacking section by the transport section arrives at the downstream-side end portion of the first stacking section.

5. The sheet stacking apparatus according to claim 1, wherein the air blowing section makes the air quantity to blow a smaller air quantity than a previous air quantity before the upstream end of the sheet transported from the first stacking section to the second stacking section by the transport section arrives at the downstream-side end portion of the first stacking section.

6. The sheet stacking apparatus according to claim 1, further comprising:

a processing section adapted to apply processing to a sheet bunch comprised of a plurality of sheets stacked on the first stacking section, wherein the transport section transports the sheet bunch applied with the processing by the processing section from the first stacking section to the second stacking section.

7. An image forming system comprising:

an image forming apparatus provided with an image forming section for forming an image on a sheet, and the sheet stacking apparatus for stacking sheets with images formed by the image forming apparatus according to claim 1.

8. An image forming system comprising:

an image forming apparatus provided with an image forming section for forming an image on a sheet, and the sheet stacking apparatus for stacking sheets with images formed by the image forming apparatus according to claim 2.

* * * * *